US007585196B1

(12) United States Patent
Jaeger

(10) Patent No.: US 7,585,196 B1
(45) Date of Patent: Sep. 8, 2009

(54) MARINE PROPULSION SYSTEM WITH AN OPEN COOLING SYSTEM THAT AUTOMATICALLY DRAINS WHEN THE MARINE VESSEL IS TAKEN OUT OF THE WATER

(75) Inventor: Matthew W. Jaeger, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/953,384

(22) Filed: Dec. 10, 2007

Related U.S. Application Data

(63) Continuation-in-part of application No. 11/982,898, filed on Nov. 6, 2007, now Pat. No. 7,476,135, and a continuation of application No. 11/445,348, filed on Jun. 1, 2006, now Pat. No. 7,329,162, which is a continuation-in-part of application No. 11/445,348.

(51) Int. Cl.
*F01P 3/20* (2006.01)

(52) U.S. Cl. ..... 440/88 HE; 440/88 C

(58) Field of Classification Search ..... 440/88 C, 440/88 HE, 88 N, 88 R, 89 R
See application file for complete search history.

(56) References Cited

U.S. PATENT DOCUMENTS

| | | | | |
|---|---|---|---|---|
| 2,466,525 | A | 4/1949 | Wilson | |
| 4,741,715 | A | 5/1988 | Hedge | |
| 5,334,063 | A | 8/1994 | Inoue et al. | |
| 5,337,774 | A * | 8/1994 | Boyd | 440/88 N |
| 5,628,285 | A | 5/1997 | Logan et al. | |
| 5,746,270 | A | 5/1998 | Schroeder et al. | |
| 5,902,159 | A | 5/1999 | Killpack et al. | |
| 5,966,080 | A | 10/1999 | Bigsby | |
| 5,980,342 | A | 11/1999 | Logan et al. | |
| 6,050,867 | A | 4/2000 | Shields et al. | |
| 6,089,934 | A | 7/2000 | Biggs et al. | |
| 6,135,064 | A | 10/2000 | Logan et al. | |
| 6,343,965 | B1 | 2/2002 | Biggs et al. | |
| 6,374,849 | B1 | 4/2002 | Howell | |
| 6,379,201 | B1 | 4/2002 | Biggs et al. | |
| 6,390,870 | B1 | 5/2002 | Hughes et al. | |
| 6,406,344 | B1 * | 6/2002 | Bland et al. | 440/88 R |
| 6,439,939 | B1 | 8/2002 | Jaeger | |
| 6,478,643 | B2 * | 11/2002 | Jolley | 440/88 R |
| 6,506,085 | B1 | 1/2003 | Casey et al. | |
| 6,582,263 | B1 | 6/2003 | Jaeger et al. | |
| 6,645,024 | B1 | 11/2003 | Zumpano | |
| 6,912,895 | B1 | 7/2005 | Jaeger | |

(Continued)

OTHER PUBLICATIONS

U.S. Appl. No. 11/445,348, Caldwell et al.

*Primary Examiner*—Lars A Olson
(74) *Attorney, Agent, or Firm*—William D. Lanyi

(57) ABSTRACT

A cooling system for a marine propulsion device provides a transom opening that is sufficiently low with respect to other components of the marine propulsion device to allow automatic draining of all cooling water from the system when the marine vessel is removed from the body of water in which it had been operating. The engine cooling passages and other conduits and passages of the cooling system are all located at positions above the transom opening. The system provides automatic draining for a marine cooling system that is an open system and which contains no closed cooling portions.

17 Claims, 5 Drawing Sheets

U.S. PATENT DOCUMENTS 7,195,055 B1 3/2007 Jaeger
7,329,162 B1 * 2/2008 Caldwell et al. ..... 440/88 HE
7,476,135 B2 * 1/2009 Caldwell et al. ..... 440/88 HE
2004/0106338 A1 6/2004 Nakajima et al.

* cited by examiner

MARINE PROPULSION SYSTEM WITH AN OPEN COOLING SYSTEM THAT AUTOMATICALLY DRAINS WHEN THE MARINE VESSEL IS TAKEN OUT OF THE WATER

CROSS REFERENCE TO RELATED APPLICATIONS

This application is a continuation-in-part of U.S. patent application Ser. No. 11/445,348 filed on Jun. 1, 2006 now U.S. Pat. No. 7,329,162, and a continuation-in-part of U.S. patent application Ser. No. 11/982,898 filed on Nov. 6, 2007 now U.S. Pat. No. 7,476,135, both incorporated herein by reference. The 11/982,898 application is a continuation of the 11/445,348 application.

BACKGROUND OF THE INVENTION

1. Field of the Invention

The present invention is generally related to a cooling system for a marine propulsion device and, more particularly, to an open cooling system that automatically drains when the marine vessel is taken out of the water.

2. Description of the Related Art

Those skilled in the art of marine propulsion systems are well aware of many different types of cooling systems used to remove heat from components of the marine propulsion system. Some marine propulsion devices use an open cooling system, in which water is drawn from a body of water and circulated through the system in thermal communication with heat emitting devices, while other systems are closed systems, or partially closed systems, in which a coolant, such as ethylene glycol, is circulated in thermal communication with the heat emitting portions of those components. The partially closed systems normally use a liquid-to-liquid heat exchanger that circulates the ethylene glycol in thermal communication with water that is drawn from the body of water in which the marine vessel operates. In either type of cooling system, it is significantly beneficial if the water which is drawn from the body of water can be easily and quickly removed from the cooling system when the marine vessel is taken out of the water. The act of draining this water from the cooling system sometimes requires the operator of the marine vessel to perform numerous tasks. The degree of complexity required to drain the cooling system of a marine vessel can vary from relatively simple to highly complex. However, cooling systems for marine vessels typically require at least a minimum of manual intervention to cause the water to drain from the internal cavities of the cooling system.

U.S. Pat. No. 2,466,525, which issued to Wilson on Apr. 5, 1949, describes a cooling device for power plants of boats. Saltwater is used as the cooling medium. As a result, it eliminates the necessity of using circulating pumps which are subject to a number of disadvantages. The device provides in the bottom of a boat a water circulating tank though which cold saltwater is passed and also through which the cooling medium is circulated to be cooled by the saltwater. An improved means for introducing cold saltwater is provided and it evacuates warmed or heated saltwater which has contacted the cooling medium of the power plant.

U.S. Pat. No. 4,741,715, which issued to Hedge on May 3, 1988, discloses a pressure actuated drain valve for a marine drive. The drain valve automatically drains the cooling water from a marine drive engine when the engine is stopped. The drain valve includes a spring-loaded diaphragm which moves to a closed position when the engine water pump is operating to close an outlet from the engine cavities to be drained. The diaphragm automatically moves to its open position when the engine water pump is off to open the outlet to allow cooling water to drain from the engine cavities.

U.S. Pat. No. 5,334,063, which issued to Inoue et al. on Aug. 2, 1994, describes a cooling system for a marine propulsion engine. The invention permits draining of the engine cooling jacket when it is not being run. In some embodiments, the drain valve also controls the communication of the coolant from the body of water in which the watercraft is operating with the engine cooling jacket. Various types of pumping arrangements are disclosed for pumping the bilge and automatic valve operation is also disclosed.

U.S. Pat. No. 5,628,285, which issued to Logan et al. on May 13, 1997, discloses a drain valve for a marine engine. The valve assembly automatically drains water from a cooling system of an inboard marine engine when the ambient temperature drops to a preselected value. The drain valve includes a cup-shaped base having a group of inlets connected to portions of a cooling system of the engine to be drained, and the open end of the base is enclosed by a cover. Each inlet defines a valve seat and a sealing piston is mounted for movement in the base and includes a series of valve members that are adapted to engage the valve seats. An outlet is provided in the side wall of the cup-shaped base. The valve members on the sealing piston are biased to a closed position by a coil spring and a temperature responsive element interconnects the sealing piston with the cover. The temperature responsive element is characterized by the ability to exert a force in excess of the spring force of the coil spring when the ambient temperature is above approximately 50 degrees Fahrenheit to thereby maintain the valve members in the closed position. When the temperatures falls below the selected temperature, the temperature responsive element will retract, thereby permitting the valve members to be open under the influence of the spring to automatically drain water from the cooling system of the engine.

U.S. Pat. No. 5,746,270, which issued to Schroeder et al. on May 5, 1998, discloses a heat exchanger for a marine engine cooling system. The cooling system is a closed loop cooling system. The heat exchanger body encloses a series of tubes carrying sea water which removes heat from the engine coolant. The heat exchanger includes an integrally connected top tank. A single venting orifice is provided into the top tank from the heat exchanger body. A heat exchanger coolant outlet is in direct fluid communication with both a system bypass and the coolant in the top tank. An auxiliary inlet for coolant from the top tank is located in the heat exchanger coolant outlet downstream of the bypass inlet, thereby promoting the ability of the system to draw coolant through the top tank rather than the bypass. The invention minimizes cavitation and reduces the creation of negative pressure at the circulating pump.

U.S. Pat. No. 5,902,159, which issued to Killpack et al. on May 11, 1999, describes an inboard/outboard motor cooling system winterizer. The device is intended for flushing or winterizing an inboard/outboard engine cooling system having an open basin for submerging cooling system intake portals in liquid. The basin is capable of being removably and sealably disposed about a sterndrive housing and allowing the sterndrive housing of the motor to pass through the bottom of the basin.

U.S. Pat. No. 5,966,080, which issued to Bigsby on Oct. 12, 1999, discloses a drain plug warning system. The system includes a first member that can be attached to a transom or other wall of a watercraft and a second member that is shaped to be received within an aperture that is formed through the first member. The drain water from the watercraft, the drain plug or second member is removed from the aperture of the first member, and water is allowed to drain through the aperture. If the second member is not replaced within the aperture to a predetermined location relative to the first member, a magnetically sensitive component near the aperture assumes a state that will cause an alarm under certain predefined conditions such as when an operator activates a key switch mechanism of the watercraft.

U.S. Pat. No. 5,980,342, which issued to Logan et al. on Nov. 9, 1999, discloses a flushing system for a marine propulsion engine. The system provides a pair of check valves that are used in combination with each other. One of the check valves is attached to a hose located between the circulating pump and the thermostat housing of the engine. The other check valve is attached to a hose through which fresh water is provided.

U.S. Pat. No. 6,050,867, which issued to Shields et al. on Apr. 18, 2000, discloses a drain system for a marine vessel. The system is provided for a marine vessel in which three types of drain operations can be performed at one common location near the transom of the marine vessel. A multiple conduit structure is provided with a plurality of fluid passages extending at least partially through the structure. A first fluid passage allows the bilge of the boat to be drained. A second fluid passage allows multiple locations on the engine to be drained through a common port. A second sealing plug is provided to close the second passageway that prevents fluid communication between the various fluid conduits used to drain the cooling water of the engine. A third fluid passage is provided through the multiple conduit structure to allow lubricating oil to be drained from the engine.

U.S. Pat. No. 6,089,934, which issued to Biggs et al. on Jul. 18, 2000, discloses an engine cooling system with a simplified drain and flushing procedure. The system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which is, in turn, attached to a handle. By manipulating the handle, the tether forces the retainer to slide along the flexible conduits and control the position of second ends of the flexible conduits. This allows the system to be moved from a first position with the second ends of the conduits above the first ends of the conduits to a second position with the second ends of the conduits below the first ends and in the bilge of the boat. The system allows an operator to stand in a single location and move the drain system from the first and second position and back again without having to reach down into the engine compartment to remove drain plugs. The system allows the cooling system to be easily drained or flushed.

U.S. Pat. No. 6,135,064, which issued to Logan et al. on Oct. 24, 2000, discloses an engine drain system. An engine cooling system is provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

U.S. Pat. No. 6,343,965, which issued to Biggs et al. on Feb. 5, 2002, discloses a pneumatically actuated marine engine water drain system. The system is provided which includes one or more pressure actuated valves associated with the coolant water drain system. The boat operator is provided with a pressure controller that allows pressure to be introduced into the system for the purpose of actuating the drain valves and, as a result, opening various drain conduits to allow cooling water to drain from the engine cooling system into the bilge or overboard.

U.S. Pat. No. 6,374,849, which issued to Howell on Apr. 23, 2002, describes a test cock apparatus with freeze protection capability. The apparatus is intended for controlling fluid pressure and flow in a backflow preventer valve. It includes a valve housing having interior walls defining a chamber therein and including an inlet port and a discharge port communicating with the chamber for permitting fluid flow therethrough. A temperature responsive freeze protection element is positioned within the chamber and is axially movable between a closed position in sealing engagement with the interior walls of the valve housing for preventing fluid flow through the discharge port and an open position out of sealing engagement with the walls of the valve housing for permitting passage of fluid through the discharge port.

U.S. Pat. No. 6,379,201, which issued to Biggs et al. on Apr. 30, 2002, discloses a marine engine cooling system with a check valve to facilitate draining. A marine engine cooling system is provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 6,390,870, which issued to Hughes et al. on May 21, 2002, discloses a marine engine cooling system with a simplified water drain and flushing mechanism. A manifold is located at a low portion of the cooling system to allow all of the water within the cooling system to drain through a common location, or manifold. A rigid shaft is connected to a valve associated with a manifold and extending upwardly from the manifold to a location proximate the upper portion of the engine so that a marine vessel operator can easily reach the upper end of the shaft and manipulate the shaft to open the valve of the manifold. In this way, the valve can be opened to allow all of the water to drain from the engine without requiring the marine vessel operator to reach toward locations at the bottom portion of the engine.

U.S. Pat. No. 6,439,939, which issued to Jaeger on Aug. 27, 2002, discloses a siphon inhibiting device for a marine cooling system. It comprises first and second portions of a housing structure and a buoyant member disposed within the housing structure for movement along a first axis between an inlet port and an outlet port. The buoyant member is shaped to have a cylindrical portion and another portion which is shaped in the form of a frustum of a cone. Upward movement of the buoyant member causes an elastomeric seal on the buoyant member to come into contact with an internal lip formed in the housing structure, thereby creating a seal that prevents an upward flow of water in a direction from the outlet port to the inlet port. When cooling water is drained from the outlet port area, the buoyant member is forced downwardly into an open position by its own weight and the weight of the water on its inlet port side. This free movement of the buoyant member allows the water on the inlet port side to drain without manual intervention. When normal flow occurs, in a direction from an inlet port to the outlet port, the buoyant member is forced downward into an open position and water flows around the buoyant member from a water pump toward the cooling system of the engine.

U.S. Pat. No. 6,506,085, which issued to Casey et al. on Jan. 14, 2003, discloses a pump and drain apparatus for a marine propulsion system. The apparatus is contained in a common housing structure to reduce the required space needed for these components in the vicinity proximate the engine of a marine propulsion system. The valve of the drain is remotely actuated by air pressure and therefore does not require the boat operator to manually remove plugs or manually actuate mechanical components to cause the engine to drain through a drain conduit that is formed as an integral part of the housing structure.

U.S. Pat. No. 6,582,263, which issued to Jaeger et al. on Jun. 24, 2003, discloses a marine exhaust elbow structure with enhanced water drain capability. The elbow is provided with a stainless steel tube within a water outlet opening to assure that a drain opening remains open even when the exhaust elbow is exposed to a corrosive environment. Since cast iron tends to expand in volume as a result of corrosion of its surface areas, water outlet openings intended to perform a draining function can be partially or fully closed as a result of corrosion. The insertion of a stainless steel tube in one or more water outlet openings of an exhaust elbow assures that an internal water cavity of the elbow can drain when the associated internal combustion engine is turned off, thereby minimizing the possibility of freeze damage to the exhaust components.

U.S. Pat. No. 6,645,024, which issued to Zumpano on Nov. 11, 2003, describes a fresh water marine engine flushing assembly and system. Fresh water is supplied from an onboard water supply which can also serve as the water supply for drinking, galley appliances, showers, toilets, etc. A path of fluid flow is disposed in fluid communication between the maintained water supply and the marine engine and communicates therewith by an adapter assembly which is preferably permanently secured to the marine engine. A flush valve assembly is remotely controlled and preferably electronically activated so as to regulate the flow of cooling water through the cooling system, in the conventional manner, or fresh water from the maintained water supply for purposes of removing salt water remnants and contaminants.

U.S. Pat. No. 6,912,895, which issued to Jaeger on Jul. 5, 2005, discloses a coolant flow monitoring system for an engine cooling system. The monitor is removably connectable in serial fluid communication with a coolant conduit of an engine cooling system. By providing a flow restrictor between upstream and downstream ports, a differential pressure is created between the upstream and downstream ports. The measured magnitude of this differential pressure allows a microprocessor, or similarly configured component, to determine the actual flow rate of the coolant passing through the coolant conduit between the upstream and downstream pressure sensing ports. In this way, actual flow is measured to indicate the proper operation of the cooling system.

U.S. Pat. No. 7,195,055, which issued to Jaeger on Mar. 27, 2007, discloses a device for connecting a secondary heat exchanger to an engine cooling system. The secondary heat exchanger device can be connected to a primary engine cooling system by providing a flow restrictor and upstream and downstream ports, wherein the flow restrictor is disposed between the upstream and downstream ports. A heat exchanger can be connected in fluid communication with the upstream and downstream ports to receive a flow of coolant liquid that results from a differential pressure between the upstream and downstream ports because of the pressure drop caused by the flow restrictor.

U.S. patent application Ser. No. 10/672,934, which was filed by Nakajima et al. on Sep. 26, 2003, describes a cooling system for a small watercraft. It prevents corrosion or freezing in a water channel. Water outside the watercraft is fed through a pump and piping or the like to an engine in the watercraft and cools the same and then is drained from the watercraft. Drain hoses are connected to portions of the engine and piping where water tends to remain and drain ports which are capable of being opened and closed are provided at the other ends of the drain hose. A single drain valve is provided at the drain port for opening and closing the drain hose.

U.S. patent application Ser. No. 11/445,348 (M10012), which was filed on Jun. 1, 2006, discloses a cooling system for a marine propulsion device. A cooling system for a marine vessel is configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

The patents described above are hereby expressly incorporated by reference in the description of the present invention.

Although many different cooling systems are known to those skilled in the art and each of those systems is typically provided with a procedure for draining water out of the systems when the marine vessel is not in use, these processes and procedures typically require manual intervention in one way or another. Some systems require that an operator remove a plug from a conduit to allow water to flow out of the cooling system. Some systems automatically allow the water to drain into the bilge of the marine vessel, but this requires a further intervention by the operator to remove the water from the bilge. The device described in U.S. Pat. No. 5,628,285 drains to the lower exhaust pipe. The connection to the lower exhaust pipe is below the waterline and therefore requires a seacock that is manually operated. Many of the draining systems described above are intended to simplify the effort required by the operator of a marine vessel when the water is to be drained from the system. However, they all require at least a minimum of effort. The Caldwell patent described above requires no intervention by an operator of a marine vessel when the marine vessel is taken out of the body of water in which it had been operating, but the Caldwell patent relates to a cooling system that comprises both an open portion and a closed portion. In that type of system, the engine is cooled by a coolant of a closed portion of the system. That coolant need not be drained at any time since, in most cases, the coolant is provided with an antifreeze liquid, such as ethylene glycol, which prevents it from freezing and causing damage. When a system, like that described in the Caldwell patent, automatically drains water from the cooling system of the marine propulsion device, it does not drain any coolant from the engine or heat exchanger portions of the system. However, many cooling systems for marine propulsion devices do not comprise closed portions for the engine cooling system. If the cooling system is completely open, water is circulated through the engine from the body of water in which the marine vessel is operating. Unlike the combined systems that are described in the Caldwell patent, completely open systems require that all of the water be drained from the engine and other related components when the marine vessel is taken out of the body of water. It would therefore be significantly beneficial if an open cooling system could be provided which automatically drains all of the water from the cooling system when the marine vessel is removed from the body of water without requiring any intervention of any is kind by the operator of the marine vessel. It would be particularly beneficial if the water is drained to a position outside the marine vessel via the inlet water path. In other words, it would be beneficial if the system could automatically drain all of its water as the marine vessel is simply removed from the body of water, placed on a trailer, and driven away.

SUMMARY OF THE INVENTION

A marine propulsion system made in accordance with a preferred embodiment of the present invention comprises an engine disposed within a marine vessel, a drive unit attached to a transom of the marine vessel and connected in torque transmitting association with the engine, a cooling system comprising at least one engine cooling passage disposed in thermal communication with heat emitting portions of the engine, a water inlet configured to receive water from a body of water in which the marine vessel is operating and to direct the water into the cooling system, an inlet conduit connected in fluid communication with the water inlet and with the engine cooling passage, a pump disposed within the drive unit, and a check valve disposed in fluid communication between the engine cooling passage and the inlet conduit.

In a particularly preferred embodiment of the present invention, the drive unit is configured to support a propeller shaft for rotation about a generally horizontal axis. The water inlet is an opening formed through a surface of the drive unit in a preferred embodiment of the present invention. The inlet conduit is configured to direct the water from the body of water to the engine cooling passage in order to remove heat from the heat emitting portions of the engine. The inlet conduit extends through a transom opening which is at a lower position than the cooling system and the engine cooling passage. As a result, water which is within the cooling system when the marine vessel is removed from the body of water will flow out of the cooling system and through the transom under the force of gravity and without manual intervention. The transom opening is lower than an axis of rotation of a crankshaft of the engine.

In a preferred embodiment of the present invention, the engine cooling passage comprises conduits which extend through a head and block of the engine. All water within the cooling system when the marine vessel is removed from the body of water will flow in a generally downward and rearward direction toward the transom opening.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
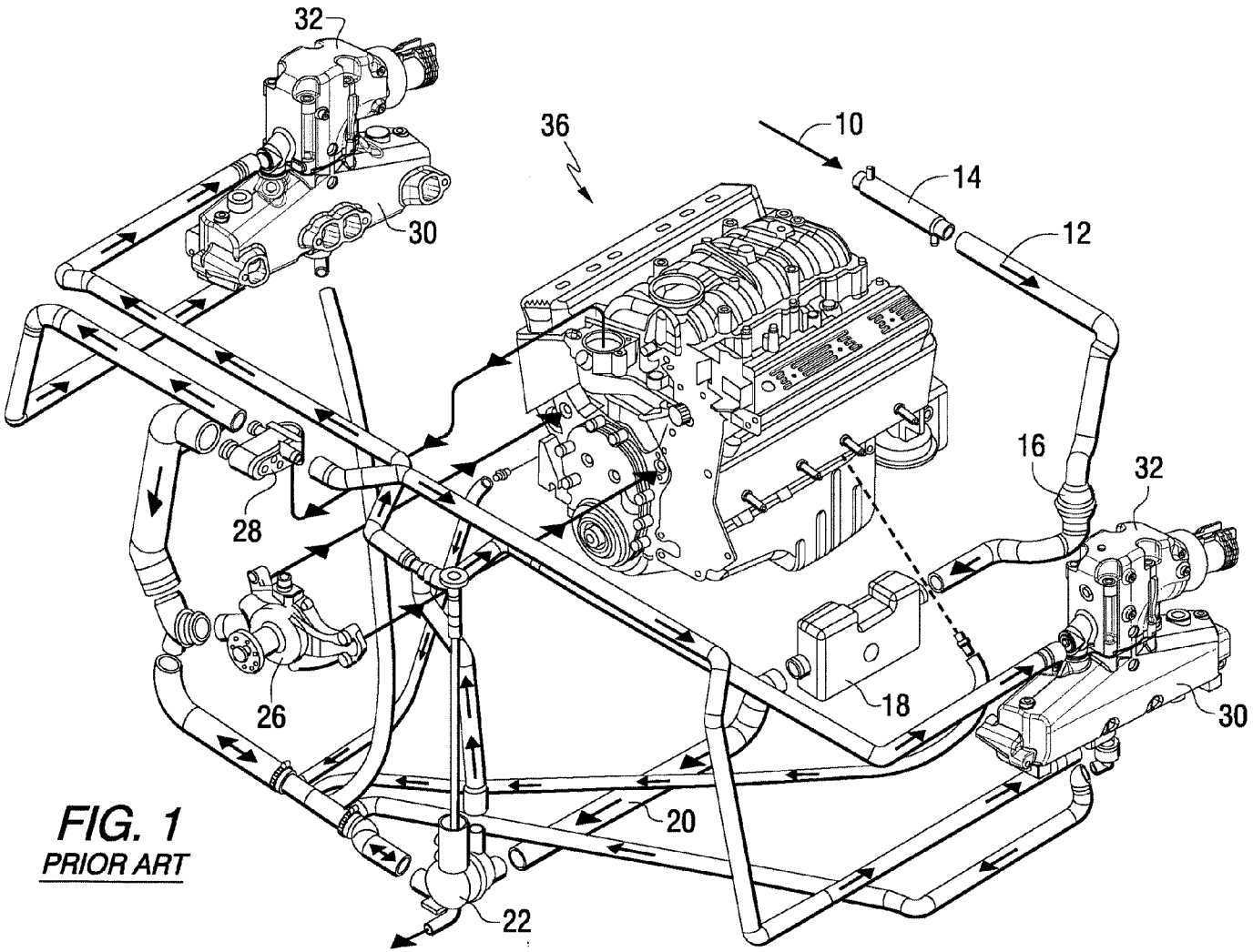
FIG. 1 PRIOR ART
FIG. 1 is an isometric representation of a cooling system known to those skilled in the art.

Throughout the description of the preferred embodiment of the present invention, like components will be identified by like reference numerals.

FIG. 1 shows a well known type of cooling system used in conjunction with a marine propulsion device. Water is drawn from a body of water, as schematically represented by arrow 10, and directed through an inlet conduit 12. In the example shown in FIG. 1, this water is also directed through a power steering cooler 14, a check valve 16, and a fuel cooler 18. The water continues through conduit 20 to a distribution housing 22. The system is also provided with a water circulating pump 26 and a thermostat housing 28.

With continued reference to FIG. 1, the exhaust system comprises exhaust manifolds 30 which are each associated with an exhaust elbow 32. Some of the cooling water circulating through the conduits in FIG. 1 is injected into the exhaust gas stream flowing through the exhaust components and carried with the exhaust stream through the transom of the marine vessel. The cooling water is returned to the body of water through the drive unit which is attached to the transom of the marine vessel. This arrangement will be described in greater detail below. Cooling passages within the structure of the engine 36 receive water flowing through the conduits shown in FIG. 1 and that cooling water removes heat from heat emitting components of the engine. In addition, the cooling nature of the water flowing through the conduits in FIG. 1 also removes heat from various other components, such as the power steering cooler 14 and the fuel cooler 18. In addition, other components can be connected in thermal communication with the cooling water in other applications.

Figure 2:
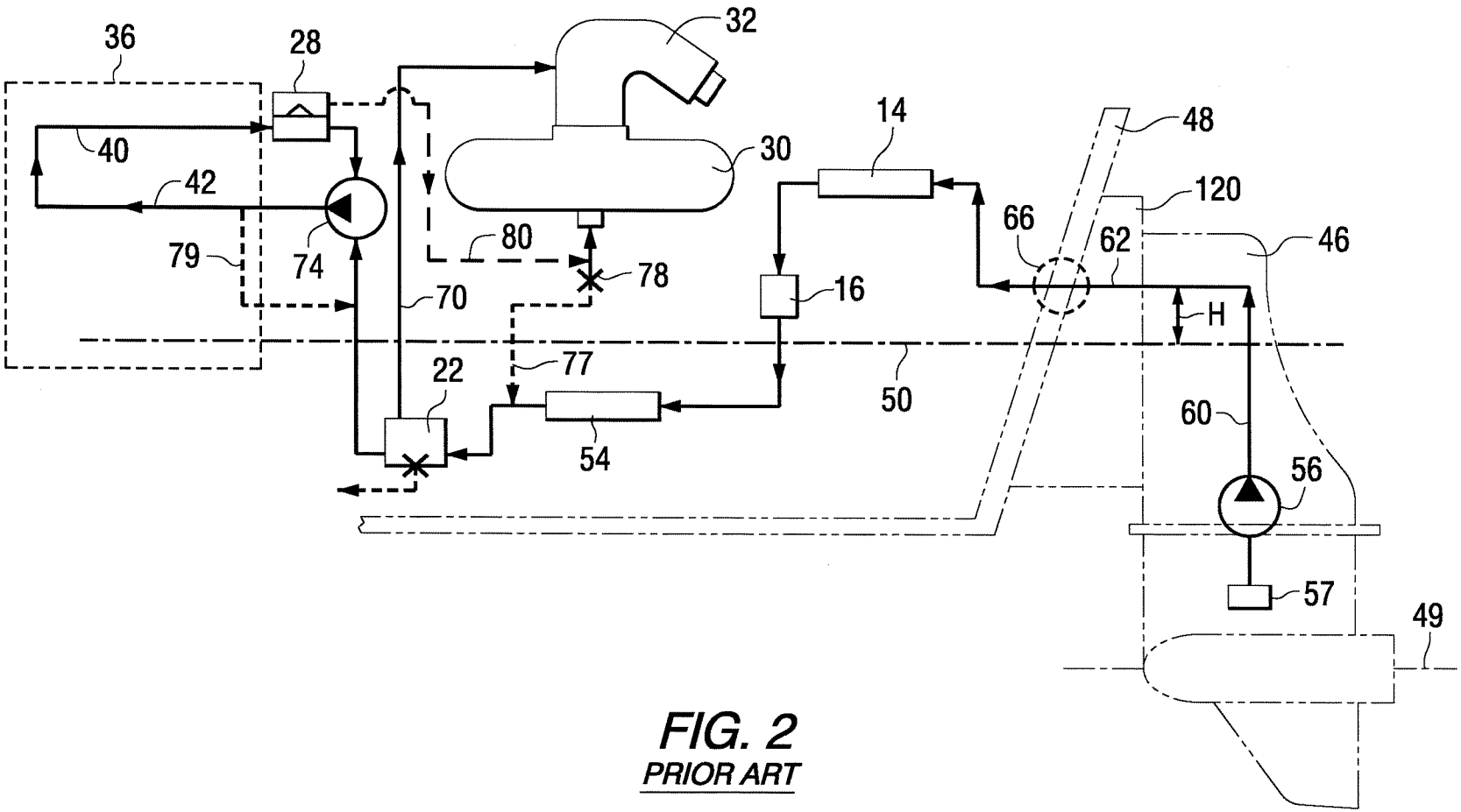
FIG. 2 PRIOR ART
FIG. 2 is a side schematic representation of a cooling system such as that illustrated in FIG. 1.

FIG. 2 is a side schematic view of a cooling system for a marine propulsion device similar to that described above in conjunction with FIG. 1. The engine 36 is shown with arrows representing the flow of cooling water through its head 40 and block 42. The thermostat 28 regulates the flow of cooling water through the engine cooling passages. Also shown in the schematic representation of FIG. 2 are the exhaust manifold 30 and exhaust elbow 32. A drive unit 46 is attached to a transom 48 of the marine vessel. Dashed line 50 represents the axis of rotation of a crankshaft of the engine 36. Also shown in FIG. 2 is the water distribution housing 22 and a fuel supply module 54. The various components shown in FIG. 2 are illustrated at their approximate height relative to the centerline 50 of the crankshaft and the exhaust manifold 30 and elbow 32. When in operation, a pump 56 draws water through openings formed in the surface of the drive unit 46 that serve as a water inlet 57. The water inlet 57 is simply an opening in the housing surface of the drive unit 46 and can comprise a plurality of holes or louvers that permit water to flow from the body of water in which the unit is operated and under the influence of the pump 56. The water is induced to flow through a water conduit 60 within the drive unit 46 and then through a conduit 62 that extends through a transom opening 66 at a position which is above the centerline 50 of the crankshaft. The water continues to flow, under the inducement provided by the pump 56, through the power steering fluid cooler 14, the check valve 16, the fuel module 54, and the water distribution housing 22. A portion of the water is directed, as represented by arrow 70, to the exhaust components, such as the exhaust elbow 32. Some of the water from the water distribution housing 22 is directed to a circulation pump 74 that circulates the water through the cooling passages, 40 and 42, of the engine 36.

With continued reference to FIG. 2, the check valve 16 can be a check valve made in accordance with U.S. Pat. No. 6,439,939 which is described above. In addition, a checked drain line on each side of the system, at the location identified by reference numeral 78, can be provided and made according to U.S. Pat. No. 6,379,201, which is described above. Another drain line 79 is provided in the cooling system shown in FIG. 2. That drain line allows a continuously recirculating stream of cooling water from the engine block 42 whenever the engine is operating. Dashed line 80 represents a continuous flow of cooling fluid from the thermostat 28. This water flows at a slow rate into the manifolds 30.

With continued reference to FIG. 2, numerous portions of the cooling system illustrated in FIG. 2 are located below the transom opening 66. As a result, if the marine vessel is removed from the body of water in which it is operating, some of the water within the conduits and components of the cooling system will settle into positions within the cooling system that are below the transom opening 66. They will not be able to flow out of the marine vessel through the transom 48 and through the guide unit 46. Instead, they will remain within the cooling system. In a system like that shown in FIG. 2, the operator must take some action to remove the remaining water from the cooling system. Numerous patents are described above which provide various systems and components that assist the operator in doing this. In a typical system of that type, the operator takes some action to cause the water to flow from the cooling system into the bilge of the boat. From the bilge, this water can be pumped out of the marine vessel. It is a goal of the present invention to eliminate the need for the operator to intervene in this operation. Instead, the goal of the present invention is to cause the water within the cooling system to completely drain out of the cooling system and out of the marine vessel without any intervention by the marine vessel operator. In addition, it is the goal of the present invention to cause this draining procedure to proceed without intervention even in a cooling system that is completely open with no closed portion. Furthermore, it is one of the goals of the present invention to cause the draining procedure to proceed automatically without intervention and without the need for a seacock.

Figure 3:
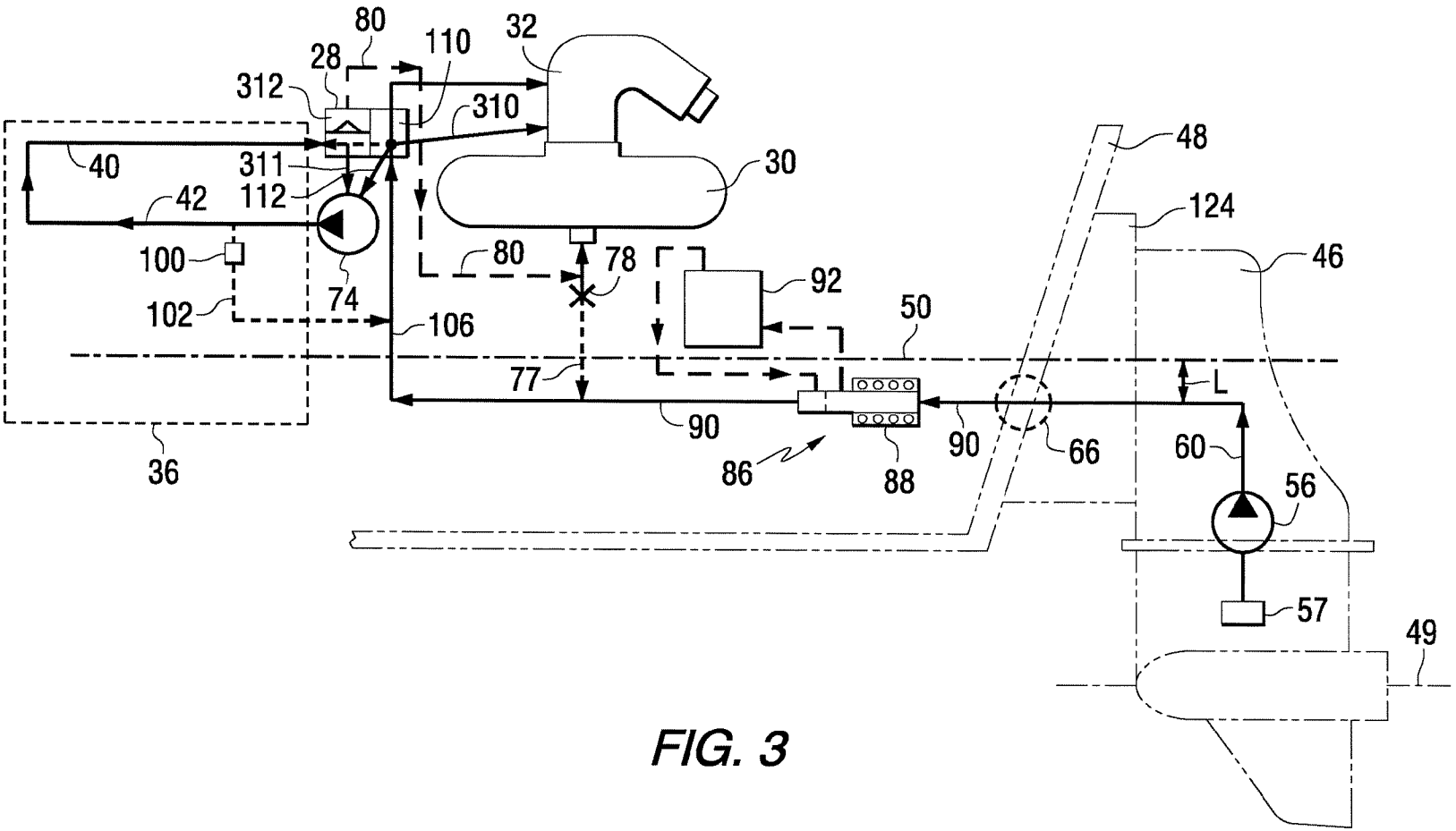
FIG. 3 shows a side schematic representation of a cooling system made in accordance with a preferred embodiment of the present invention.

FIG. 3 shows a marine propulsion system that is generally similar to that described above in conjunction with FIG. 2, but configured to facilitate the draining of the cooling system without any manual intervention. Some of the components shown in FIG. 3 are the same as those described above in conjunction with FIG. 2. The engine 36 has a cooling passage that directs water through the head 40 and block 42 to remove heat therefrom. In addition, the system has exhaust manifolds 30 and exhaust elbows 32. The drive unit 46 is attached to the transom 48 and is provided with a pump 56 that draws water through a water inlet 57 from the body of water in which the marine vessel is operating. As in the system described above in conjunction with FIG. 2, the pump 56 in FIG. 3 induces the flow of water through an inlet conduit 60 which extends through a transom opening 66. From there, the water is directed by various conduits to the engine 36 and other components from which heat is removed. As an example, a component 86 is shown in FIG. 3. It is a combination of a power steering cooler 88 and an orifice device that causes a portion of the water flowing through conduit 90 to flow through a fuel supply module 92. The orifice device portion of component 86 is described in U.S. Pat. No. 7,195,055 which is described above. The metered flow of water through the fuel system module 92 is represented by the dashed line arrows associated with that component and with the orifice device 86. As described above in conjunction with FIG. 2, a check drain line arrangement 78 is provided on each side of the system. This arrangement is described in detail in U.S. Pat. No. 6,379,201. In a preferred embodiment of the present invention, the thermostat 28 is selected to facilitate the flow of water through its structure. A thermostat of this type is available in commercial quantities from Caltherm, Inc. and is identified by part number CT10-640-02. It has a vent notch within its structure that assists in providing a drain through which cooling water can flow when the engine 36 is not running.

The system shown in FIG. 3 also comprises a check valve 100 that performs an important function in the operation of a preferred embodiment of the present invention. The check valve is configured to respond to the pressure of cooling water within the engine 36. This pressure, when above a threshold magnitude, causes the check valve to close. This feature prevents the loss of warmed water during startup of the engine when it is desirable to cause the cooling water within the engine to rise as fast as possible to the thermostat controlled temperature. When the pressure of the cooling water within the engine 36 falls below the threshold magnitude, such as when the engine is turned off, a spring loaded portion of the valve 100 opens a passage and permits water to drain from the engine block and head as represented by dashed line arrow 102. Those skilled in the art of marine propulsion systems are aware of many different types of relatively simple pressure controlled check valves that can perform this function. The spring within the check valve can be selected to hold the valve in an open condition when the cooling water pressure within the engine is less than 1.5 psi greater than the pressure within the inlet conduit at the location identified by reference numeral 106. In other words, the check valve 100 operates on the differential pressure between the water in the passages identified by reference numerals 42 and 102. For purposes of reference, this differential pressure sensed by the check valve 100 would typically be 0.5 psi or less when the boat is at rest and the engine is not operating. When the engine 36 is idling, the differential pressure sensed by valve 100 would be approximately 1.5 psi. When the engine 36 is operating in a wide open throttle condition, the differential pressure between passages 42 and 102 would be equal to or greater than 4.0 psi.

Although not specifically illustrated in FIG. 3, it should be understood that the valve 100 could alternatively be a solenoid controlled valve that closes when the engine ignition system is active (e.g. when the ignition key is on) and opened when the ignition system is off. This is a much simpler system than the use of a differential pressure controlled check valve. In addition, since many propulsion systems use a microprocessor in one form or another, a simple on/off valve can be used as the valve 100 and the microprocessor can sense the operation of the engine (i.e. is it running or off) and can close the valve 100 when the engine is running and open it when the engine is off. Any of these alternative embodiments are capable of use with different embodiments of the present invention.

In order to facilitate the automatic draining of the water from the cooling system when the marine vessel is removed from the body of water in which it is operating, the thermostat 28 in FIG. 3 is selected to be different than the thermostat 28 in FIG. 2. Although they both perform the expected functions of a thermostat, relating to the regulation of the temperature of water circulating through the engine 36, the housing structure of the thermostat 28 in FIG. 3 is modified to function in a slightly different way. When the thermostat is operating normally, it operates in the manner described immediately below. When water flows from the pump 56 through the inlet conduit 90, it flows through conduit 106 into a chamber 110 of the thermostat housing. From that chamber, shown on the right in the schematic representation of FIG. 3, water can flow in two directions. Most of the water flows in the direction represented by arrow 310 and overboard through the exhaust elbows and subsequent water passages. In other words, pump 56 generally displaces more cooling water than the engine requires for cooling. A small portion of the water flowing upwardly through conduit 106 flows from chamber 110 and into the circulating pump via conduit 112. This incoming water replaces the heated water released by the thermostat through conduit 80 to the exhaust manifolds. Cooling water in the engine conduit 40 enters chamber 312 within the thermostat housing. Most of this water recirculates through the engine via path 311. However, as noted above, some portion of the heated water is released from the engine across the thermostat and exits from the system via conduit 80. The rate of release is dependent on the load and speed at which the engine is operating and the temperature of the incoming water in conduit 106. The heated water released through conduit 80 is replaced by the cold incoming water via conduit 112. When the engine is turned off, the water drains from chamber 110 and the conduit 311 under the influence of gravity. In addition, water drains from the engine cooling passage, 40 and 42, through the check valve 100 and conduit 102.

In order to achieve the goals of the preferred embodiments of the present invention and allow the cooling system to automatically drain when the marine vessel is removed from the body of water in which it is operating, several important steps are taken. Some of these steps can be recognized by comparing FIGS. 2 and 3. For example, the check valve 100 is provided in a preferred embodiment of the present invention as shown in FIG. 3. This allows the draining function to occur through line 102, but also causes an adequate build up of temperature in the engine cooling water within the engine cooling passage, 40 and 42. When the engine is turned off, the check valve 100 is open and water can drain from the engine through conduit 102 and 106 to the inlet conduit 90. Another helpful feature that can be seen in FIG. 3 is the provision of the thermostat housing with chambers 110 and 312. The thermostat housing shown in FIG. 3 is a thermostat housing known to those skilled in the art and it has been used for numerous years on other marine cooling systems. A section view of that thermostat housing is shown in FIG. 5.

With continued reference to FIGS. 2 and 3, it should be noted that in FIG. 2 the transom opening 66 is above the axis of rotation 50 of the crankshaft of the engine 36. This height differential is identified by arrow H in FIG. 2. In FIG. 3, it can be seen that a preferred embodiment of the present invention places the transom opening 66 at a location which is lower than the centerline of the crankshaft 50. This distance is identified by arrow L in FIG. 3. For purposes of reference, marine propulsion systems that are well known to those skilled in the art, such as the system illustrated in FIG. 2, typically locate the transom opening 66 at a location which is approximately 72.9 millimeters (approximately 2.87 inches) above the axis of rotation 50 of the crankshaft. In comparison, as will be described in greater detail below, the preferred embodiment of the present invention places the transom opening 66 72.1 millimeters (approximately 2.84 inches) below the axis of rotation 50 of the engine crankshaft. As a result, the transom opening 66 in FIG. 3 is approximately 145 millimeters (approximately 5.71 inches) lower than the transom opening 66 shown in FIG. 2 and known to those skilled in the art of marine propulsion systems. Since it is important that all of the portions of the cooling system be located above the transom opening 66, this significant lowering of the transom opening 66 facilitates the achievement of the goals described above. With the lower transom opening 66, it is easier to locate the engine cooling passage, 40 and 42, the exhaust manifolds 30, and the other components that are cooled by the cooling water, above the location of the transom opening 66. This is important because when the marine vessel is removed from the body of water in which it is operating, the natural draining of the water from the engine 36 and other components of the cooling system require that the water be allowed to run downhill under the influence of gravity and without the need for intervention by the operator of the marine vessel. Without lowering the transom opening 66, the placement and positioning of these components of the cooling system above that transom opening would be extremely difficult, if not impossible.

Figure 4:
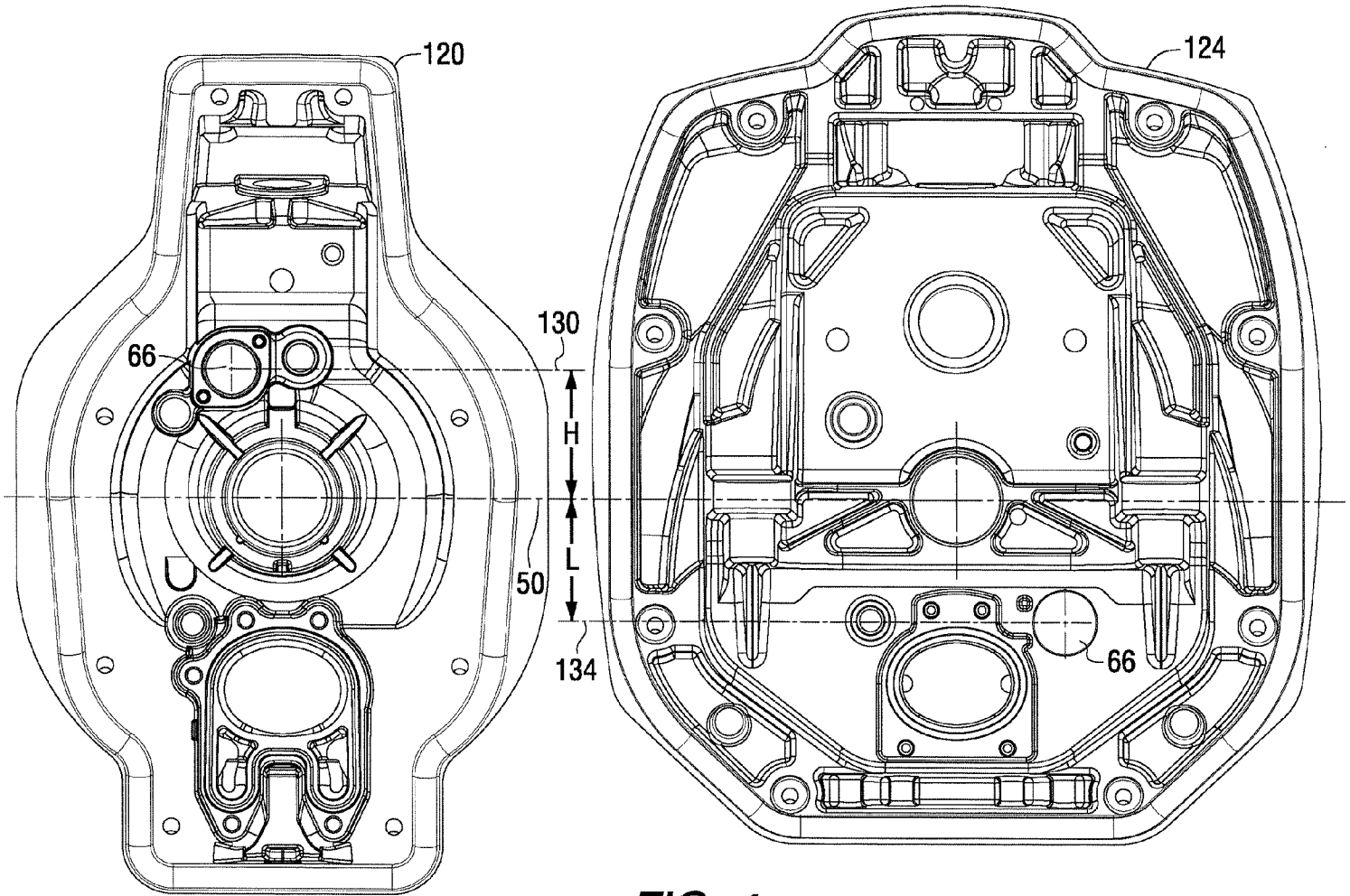
FIG. 4 shows a comparison of transom plates between a known type of cooling system and the preferred embodiment of the present invention.

FIG. 4 shows two transom plates, 120 and 124, that explain one of the techniques used to achieve the goals of the present invention. Transom plate 120 is generally well known to those skilled in the art and has been used on many different types of marine propulsion systems. Transom plate 124 is modified to assist in the achievement of the goals of the present invention. Dashed line 50 represents the height of the axis of rotation 50 of the crankshaft of the engine 36 as described above in conjunction with FIGS. 2 and 3. Line 130 represents the position of the transom opening 66 on transom plate 120. This position, as described above in conjunction with FIG. 2, is higher than the axis of rotation 50 of the crankshaft. This height is identified by arrow H. The transom plate 124 places the transom opening 66 at a location identified by line 134. This is lower than the centerline of the crankshaft by a magnitude identified by arrow L in FIG. 4. Since, as described above, arrow H is 72.9 millimeters (approximately 2.87 inches) and arrow L is 72.1 millimeters (approximately 2.84 inches), a height advantage of 145 millimeters (approximately 5.71 inches) is achieved through the use of transom plate 124 in place of transom plate 120. Naturally, other movement of components coincides with the location of the transom opening 66 in the transom plates, 120 and 124, but it should be realized that the transom plate modification described in conjunction with FIG. 4 is an integral part of this helpful change.

With continued reference to FIGS. 2 and 3, it should be understood that certain other design steps should be taken in combination with the use of the various advantageous components such as the check valve 100, the thermostat with chambers 110 and 312, and the transom plate 124, as described in greater detail above. The various conduits that connect the components to the cooling system should be arranged so that water pumped by the pump 56 flows in a generally upward direction as it is directed from the pump 56, through the transom opening 66, and to the engine 36. It is particularly useful if the inlet conduit 90 directs the water in a generally upward direction as it extends from the transom 48 to the components associated with the engine 36. Certain portions of this inlet conduit 90, and its connected conduit 106 and 102, may require generally horizontal positioning in order to achieve appropriate connection to its associated components. However, downward sloping of these conduits, as they extend from the transom to the engine and other associated components, should be avoided if possible.

One of the steps taken to achieve the overall goals of the present invention is to provide downward sloping conduits which extend from the engine and its associated components back to the transom opening 66. As a result, raising the marine vessel out of the body of water in which it had been operating will naturally result in the downward flow of water within the cooling system and its passage through the transom opening 66 and the drive unit 46.

The provision of sloping conduits and the avoidance of "traps" that can retain water within the cooling system after it is drained has been described in the Caldwell patent described above. However, the Caldwell patent provides this type of self-draining system for a cooling system that comprises both an open portion which uses water from a body of water and a closed system which uses a coolant that remains in place within the closed cooling system. When this type of system, such as described in the Caldwell patent, is used, the engine uses the closed portion and need not be drained. This is also true for the closed portion of the heat exchanger which is used to cool the coolant which circulates through the engine components. The present invention is intended to provide a self-draining system for a marine cooling system that contains no closed portion. In other words, the present invention provides an automatically draining system for a marine cooling system which uses water from a body of water to cool all heat emitting components.

The thermostat housing 28 described above in conjunction with FIG. 3 is illustrated schematically to show its function in relation to providing a flow of water through conduit 112 to the circulation pump 74. As should be recognized by those skilled in the art, the thermostat housing 28 performs other functions. FIGS. 5A-5D illustrate various section views of the thermostat housing 28 which show its internal chambers and fluid passages. As described above in conjunction with FIG. 3, the thermostat housing 28 directs both heated water, received from the engine cooling passage, 40 and 42, and water that is provided through the inlet conduit 90 from the pump 56. In FIGS. 5A-5D, water that is received by the thermostat housing 28 from the engine cooling passage is represented by arrows E and water received from the pump, through the inlet conduit 90, is represented by arrows S. The flow of water through the thermostat housing 28 therefore comprises incoming sea water S which is at a relatively low temperature and which is provided by the pump 56 through the inlet conduit 90 and water from the engine cooling passages, 40 and 42, that is heated by the engine and represented by arrows E. This water is at a higher temperature than the incoming sea water S.

With continued reference to FIGS. 5A-5D, several chambers of the thermostat housing are also identified in FIGS. 5A-5D as chambers A, B, and C. With specific reference to FIG. 5A, excess incoming sea water is conducted to the exhaust elbows through channel 200 (see arrow 310 in FIG. 3). Incoming water, from the pump 56, mixes with heated recirculating water within conduit 202 this mixed flow is returned to the circulation pump 74 and the engine cooling passages, 40 and 42.

Figure 5A:
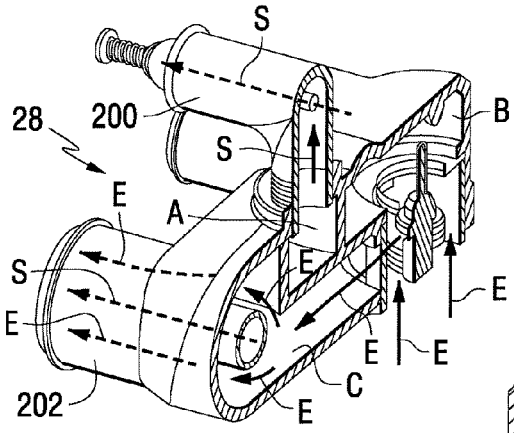
FIGS. 5A-5D are section views of a thermostat housing used in conjunction with one embodiment of the present invention.
Figure 5B:
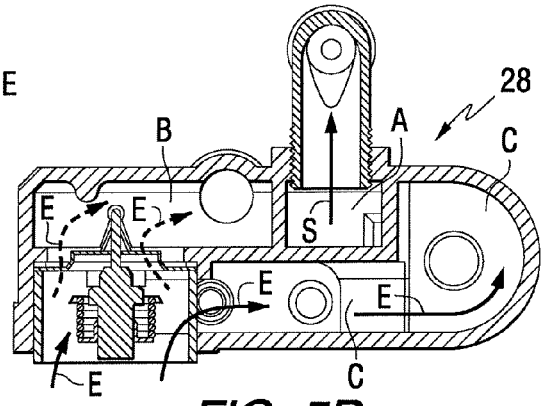

With reference to FIG. 5B, some of the water from the engine passes through the region of the thermostat if its temperature is sufficiently high. Other water E from the engine flows to chamber C as shown.

Figure 5C:
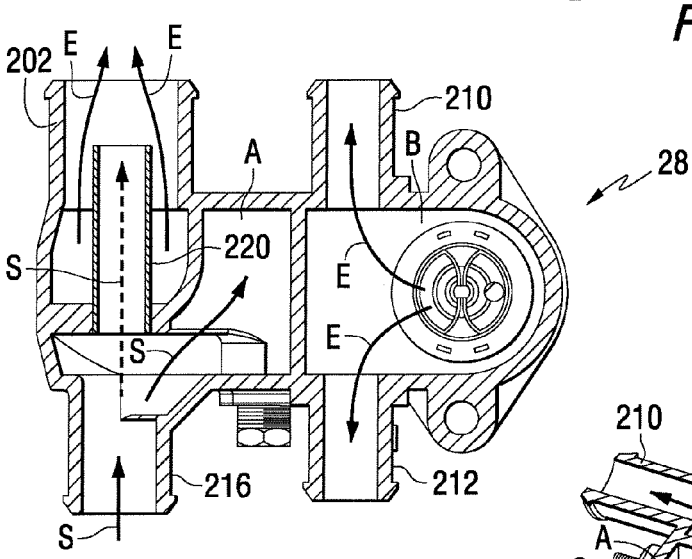

With reference to FIG. 5C, water that is passed through the thermostat flows through conduits 210 and 212 and to the exhaust manifolds. Water from the pump, flowing through inlet conduit 90, enters the thermostat housing 28 through conduit 216. Some of this water is directed through conduit 220 and is mixed with water E from the engine in conduit 202.

Figure 5D:
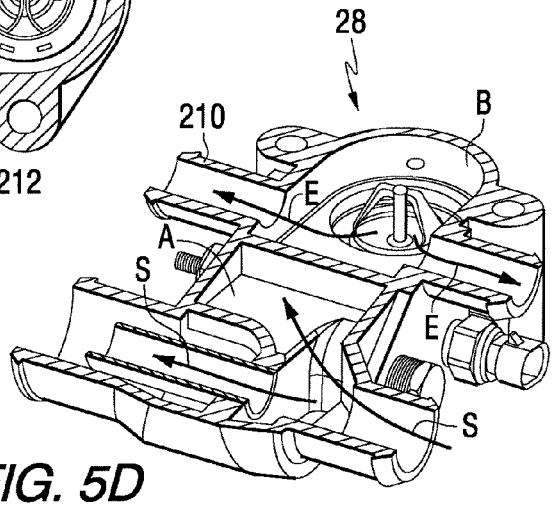

With reference to FIG. 5D, heated water that is passed through the thermostat is conducted through conduit 210 to the exhaust manifolds described above. It should be understood that the thermostat housing illustrated in FIGS. 5A-5D is generally known to those skilled in the art. Its relationship to the present invention is generally limited to the fact that it serves a useful purpose in directing the flow of water through the cooling system in a way which is beneficial to the goals of the present invention.

With continued reference to FIGS. 3, 4 and 5A-5D, it can be seen that a marine propulsion device made in accordance with a preferred embodiment of the present invention comprises an engine 36 disposed within a marine vessel. A drive unit 46 is attached to a transom 48 of the marine vessel and connected in torque transmitting association with the engine 36. The drive unit 46 is configured to support a propeller shaft for rotation about a generally horizontal axis 49. A cooling system comprises at least one engine cooling passage, 40 and 42, disposed in thermal communication with heat emitting portions of the engine 36. A water inlet 57 is configured to receive water from a body of water in which the marine vessel is operating and to direct the water into the cooling system. The water inlet 57 is an opening formed through a surface of the surface of the drive unit 46. An inlet conduit 90 is connected in fluid communication with the water inlet 57 and with the engine cooling passage 40 and 42. The inlet conduit 90 is configured to direct the water from the body of water to and through the engine cooling passage, 40 and 42, in order to remove heat from the heat emitting portions of the engine 36. The inlet conduit 90 extends through a transom opening 66 which is at a lower position than the cooling system and the engine cooling passage, 40 and 42. As a result, water which is within the cooling system when the marine vessel is removed from the body of water will flow out of the cooling system and through the transom 48 under the force of gravity and without manual intervention. The transom opening 66 is lower than an axis of rotation 50 of a crankshaft of the engine 36 in a preferred embodiment of the present invention. A pump 56 is disposed within the drive unit 46 in a preferred embodiment of the present invention. The pump 56 is connected in fluid communication between the water inlet 57 and the inlet conduit 90. A check valve 100 is disposed in fluid communication between the engine cooling passage, 40 and 42, and the inlet conduit 90. The check valve 100 is closed when the engine 36 is operating. The engine cooling passage, 40 and 42, comprises conduits which extend through a head 40 and block 42 of the engine.

All water within the cooling system when the marine vessel is removed from the body of water will naturally flow in a generally downward and rearward direction toward the transom opening 66 without any required intervention by the operator.

Although the present invention has been described with particular specificity and illustrated to show a preferred embodiment, it should be understood that alternative embodiments are also within its scope.

I claim:

1. A marine propulsion system, comprising:

an engine disposed within a marine vessel;

a drive unit attached to a transom of said marine vessel and connected in torque transmitting association with said engine, said drive unit being configured to support a propeller shaft for rotation about a generally horizontal axis;

a cooling system comprising at least one engine cooling passage disposed in thermal communication with heat emitting portions of said engine;

a water inlet configured to receive water from a body of water in which said marine vessel is operating and to direct said water into said cooling system; and an inlet conduit connected in fluid communication with said water inlet and with said engine cooling passage, said inlet conduit being configured to direct said water from said body of water to and through said engine cooling passage in order to remove heat from said heat emitting portions of said engine, said inlet conduit extending through said transom at a lower position than said cooling system and said engine cooling passage, wherein water which is within said cooling system when said marine vessel is removed from said body of water flows out of said cooling system and through said transom under the force of gravity and without manual intervention, wherein all water within said cooling system flows in a generally downward and rearward direction toward said lower position where said inlet conduit extends through said transom when said marine vessel is removed from said body of water.

2. The system of claim 1, further comprising:

a pump disposed within said drive unit, said pump being connected in fluid communication between said water inlet and said inlet conduit.

3. The system of claim 1, wherein:

said lower position is lower than an axis of rotation of a crankshaft of said engine.

4. The system of claim 1, further comprising:

a check valve disposed in fluid communication between said engine cooling passage and said inlet conduit.

5. The system of claim 4, wherein:

said check valve is closed when said engine is operating.

6. The system of claim 1, further comprising:

a fuel system module connected in fluid communication with said inlet conduit.

7. The system of claim 1, wherein:

said engine cooling passage comprises conduits which extend through a head and block of said engine.

8. The system of claim 1, wherein:

said water inlet is an opening formed through a surface of said drive unit.

9. A marine propulsion system, comprising:

an engine disposed within a marine vessel;

a drive unit attached to a transom of said marine vessel and connected in torque transmitting association with said engine, said drive unit being configured to support a propeller shaft for rotation about a generally horizontal axis;

a cooling system comprising at least one engine cooling passage disposed in thermal communication with heat emitting portions of said engine;

a water inlet configured to receive water from a body of water in which said marine vessel is operating and direct said water into said cooling system;

an inlet conduit connected in fluid communication with said water inlet and with said engine cooling passage, said inlet conduit being configured to direct said water from said body of water to said engine cooling passage in order to remove heat from said heat emitting portions of said engine, said inlet conduit extending through a transom opening which is at a lower position than said engine cooling passage, wherein water which is within said cooling system when said marine vessel is removed from said body of water flows out of said cooling system and through said transom opening without manual intervention; and a pump disposed within said drive unit, said pump being connected in fluid communication between said water inlet and said inlet conduit, wherein all water within said cooling system flows in a generally downward and rearward direction toward said transom opening when said marine vessel is removed from said body of water.

10. The system of claim 9, wherein:

said transom opening is lower than an axis of rotation of a crankshaft of said engine.

11. The system of claim 10, further comprising:

a check valve disposed in fluid communication between said engine cooling passage and said inlet conduit.

12. The system of claim 11, wherein:

said check valve closes in response to a water pressure within said engine being greater than a predetermined magnitude and opens in response to said water pressure within said engine being less than said predetermined magnitude.

13. The system of claim 12, wherein:

water can flow through said check valve, from said engine to said transom opening, when said water pressure within said engine is less than said predetermined magnitude.

14. The system of claim 13, wherein:

said engine cooling passage comprises conduits which extend through a head and block of said engine.

15. The system of claim 9, wherein:

said water inlet is an opening formed through a surface of said drive unit.

16. A marine propulsion system, comprising:

an engine disposed within a marine vessel;

a drive unit attached to a transom of said marine vessel and connected in torque transmitting association with said engine, said drive unit being configured to support a propeller shaft for rotation about a generally horizontal axis;

a cooling system comprising at least one engine cooling passage disposed in thermal communication with heat emitting portions of said engine;

a water inlet configured to receive water from a body of water in which said marine vessel is operating and to direct said water into said cooling system, said water inlet being an opening formed through a surface of said drive unit;

an inlet conduit connected in fluid communication with said water inlet and with said engine cooling passage, said inlet conduit being configured to direct said water from said body of water to said engine cooling passage in order to remove heat from said heat emitting portions of said engine, said inlet conduit extending through a transom opening which is at a lower position than said cooling system and said engine cooling passage, wherein water which is within said cooling system when said marine vessel is removed from said body of water flows out of said cooling system and through said transom under the force of gravity and without manual intervention, said transom opening being lower than an axis of rotation of a crankshaft of said engine;

a pump disposed within said drive unit, said pump being connected in fluid communication between said water inlet and said inlet conduit; and a check valve disposed in fluid communication between said engine cooling passage and said inlet conduit, said check valve being closed when said engine is operating, wherein all water within said cooling system when said marine vessel is removed from said body of water flows in a generally downward and rearward direction toward said transom opening.

17. The system of claim 16, wherein:

said engine cooling passage comprises conduits which extend through a head and block of said engine.

* * * * *